US010544530B2

(12) United States Patent
Oguchi

(10) Patent No.: US 10,544,530 B2
(45) Date of Patent: Jan. 28, 2020

(54) SHEET MANUFACTURING APPARATUS AND SHEET MANUFACTURING METHOD

(71) Applicant: SEIKO EPSON CORPORATION, Tokyo (JP)

(72) Inventor: Yuki Oguchi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 884 days.

(21) Appl. No.: 14/921,787

(22) Filed: Oct. 23, 2015

(65) Prior Publication Data

US 2016/0121564 A1 May 5, 2016

(30) Foreign Application Priority Data

Oct. 30, 2014 (JP) ..... 2014-221576

(51) Int. Cl.
*D21F 9/00* (2006.01)
*D04H 1/732* (2012.01)

(52) U.S. Cl.
CPC ..... *D04H 1/732* (2013.01)

(58) Field of Classification Search
CPC ..... D21F 9/00
USPC ..... 264/40.4
See application file for complete search history.

(56) References Cited

U.S. PATENT DOCUMENTS 5,425,834 A * 6/1995 Shinohara ..... B26D 5/20 156/264
8,882,965 B2 11/2014 Yamagami et al.
2014/0027075 A1* 1/2014 Yamagami ..... D21B 1/08 162/4

FOREIGN PATENT DOCUMENTS

JP 2012-144826 A 8/2012
JP 2015-120318 A 7/2015
JP 2015-121002 A 7/2015

* cited by examiner

*Primary Examiner* — Christina A Johnson
*Assistant Examiner* — Xue H Liu
(74) *Attorney, Agent, or Firm* — Workman Nydegger

(57) ABSTRACT

There is provided a sheet manufacturing apparatus, including: a supplying unit configured to supply a cut-form material including fibers; a detection unit configured to detect information related to a weight of the material which is processed to be supplied by the supplying unit; a defibrating unit configured to defibrate the material; and a forming unit configured to form a sheet by using at least a part of a defibrated material defibrated by the defibrating unit, in which a supply interval of at least one material among a plurality of materials to be supplied later increases in a case where the weight of the material which is supplied at a unit time is heavy rather than in a case where the weight is light.

12 Claims, 6 Drawing Sheets

SHEET MANUFACTURING APPARATUS AND SHEET MANUFACTURING METHOD

BACKGROUND

1. Technical Field

The present invention relates to a sheet manufacturing apparatus and a sheet manufacturing method.

2. Related Art

In the related art, in a sheet manufacturing apparatus, a so-called wet type method of inputting a raw material including fibers into water, disintegrating the material mainly by a mechanical operation, and repulping, is employed. Such a wet-type sheet manufacturing apparatus requires a large amount of water, and the size of the apparatus is large. Furthermore, it takes time for maintenance of a water treatment facility, and in addition to this, energy is consumed in drying.

Here, in order to reduce the size of the apparatus and save energy, a sheet manufacturing apparatus by a dry type method that does not use water as much as possible is suggested (for example, refer to JP-A-2012-144826).

In JP-A-2012-144826, a paper recycling apparatus which can obtain a recycled paper sheet having a stabilized quality by detecting a thickness of a formed sheet and adjusting an amount of paper sheets supplied to the dry-type defibrating machine based on a detection result, is described.

In the paper recycling apparatus described in JP-A-2012-144826, since the thickness of the formed sheets is measured and an amount of supplied papers is fed back, it is possible to respond to a case where a grammage of the supplied papers entirely changes (increases or decreases), but it is not possible to respond to a temporary change in the amount of supplied papers due to overlapped sending or unloaded sending that can be generated during the supply of the paper sheets.

SUMMARY

The invention can be realized in the following forms or application examples.

(1) According to an aspect of the invention, there is provided a sheet manufacturing apparatus, including: a supplying unit configured to supply a cut-form material including fibers; a detection unit configured to detect information related to a weight of the material which is processed to be supplied by the supplying unit; a defibrating unit configured to defibrate the material; and a forming unit configured to form a sheet by using at least a part of a defibrated material defibrated by the defibrating unit, in which a supply interval of at least one material among a plurality of materials to be supplied later increases in a case where the weight of the material which is supplied at a unit time is heavy rather than in a case where the weight is light.

Here, "processed to be supplied" means that the supplying unit initiates a supplying operation, and includes a case where the supplying unit is in the middle of supplying the cut-form material, or a case where the supplying unit performs the supplying operation but the material is actually not supplied.

In the sheet manufacturing apparatus, by increasing the supply interval of at least one material among the materials to be supplied later and reducing a supply amount in a case where the information related to the weight of the material which is processed to be supplied is detected and the weight of the material which is supplied at a unit time is heavy, even when the supply amount temporarily changes (increases) due to overlapped sending of the materials, it is possible to reduce the change in a grammage of a formed sheet, and to improve a quality of the sheet.

(2) In the sheet manufacturing apparatus according to the aspect of the invention, the supply interval of the material to be supplied next may increase in a case where the weight of the material which is supplied at a unit time is heavy rather than in a case where the weight is light.

In the sheet manufacturing apparatus, by increasing the supply interval of the material to be supplied next and reducing the supply amount in a case where the weight of the material which is supplied at a unit time is heavy, without prolonging an influence of the temporary change (increase) in the supply amount, it is possible to reduce the change in the grammage of the formed sheet, and to improve the quality of the sheet.

(3) In the sheet manufacturing apparatus according to the aspect of the invention, the supply interval of the plurality of materials to be supplied later may decrease in a case where the weight of the material which is supplied at a unit time is light rather than in a case where the weight is heavy.

In the sheet manufacturing apparatus, by decreasing the supply interval of the plurality of materials to be supplied later and increasing the supply amount in a case where the weight of the material which is supplied at a unit time is light, even when the supply amount temporarily changes (decreases) due to unloaded sending of the material, it is possible to reduce the change in the grammage of the formed sheet, and to improve the quality of the sheet.

(4) In the sheet manufacturing apparatus according to the aspect of the invention, the information related to the weight of the material may be information showing that the supplied materials overlap with each other.

In the sheet manufacturing apparatus, it is possible to detect the change in the supply amount due to the overlapped sending of the materials.

(5) In the sheet manufacturing apparatus according to the aspect of the invention, the information related to the weight of the material may be information showing that the material is not supplied.

In the sheet manufacturing apparatus, it is possible to detect the change in the supply amount due to the unloaded sending of the material.

(6) In the sheet manufacturing apparatus according to the aspect of the invention, the information related to the weight of the material may be information showing the weight of the material.

In the sheet manufacturing apparatus, it is possible to detect the change in the supply amount due to the supply of materials having different weights from each other.

(7) In the sheet manufacturing apparatus according to the aspect of the invention, the information related to the weight of the material may be information showing a grammage of the material.

In the sheet manufacturing apparatus, it is possible to detect the change in the supply amount due to the supply of materials having different grammages from each other.

(8) In the sheet manufacturing apparatus according to the aspect of the invention, the information related to the weight of the material may be information showing the thickness of the material.

In the sheet manufacturing apparatus, it is possible to detect the change in the supply amount due to the supply of materials having different thicknesses from each other.

(9) According to another aspect of the invention, there is provided a sheet manufacturing method, including: supplying a cut-form material including fibers; detecting information related to a weight of the material which is processed to be supplied; defibrating the material; and forming a sheet by using at least a part of a defibrated material, in which a supply interval of at least one material among a plurality of materials to be supplied later increases in a case where the weight of the material which is supplied at a unit time is heavy rather than in a case where the weight is light.

In the sheet manufacturing method, by detecting the information related to the weight of the material which is processed to be supplied and increasing the supply interval and reducing the supply amount of at least one material among the materials to be supplied later in a case where the weight of the material which is supplied at a unit time is heavy, even when the supply amount temporarily changes (increases) due to the overlapped sending of the materials, it is possible to reduce the change in the grammage of the formed sheet, and to improve the quality of the sheet.

(10) According to still another aspect of the invention, there is provided a sheet manufacturing apparatus, including: a supplying unit configured to supply a cut-form material including fibers; a detection unit configured to detect information related to a weight of the material which is processed to be supplied by the supplying unit; a defibrating unit configured to defibrate the material; and a forming unit configured to form a sheet by using at least a part of a defibrated material defibrated by the defibrating unit, in which a supply interval of at least one material among a plurality of materials to be supplied later decreases in a case where the weight of the material which is supplied at a unit time is light rather than in a case where the weight is heavy.

In the sheet manufacturing apparatus, by detecting the information related to the weight of the material which is processed to be supplied, and decreasing the supply interval and increasing the supply amount of at least one material among the plurality of materials to be supplied later in a case where the weight of the material which is supplied at a unit time is light, even when the supply amount temporarily changes (decreases) due to the unloaded sending of the material or the supply of the material having a light weight, it is possible to reduce the change in the grammage of the formed sheet, and to improve the quality of the sheet.

(11) According to still another aspect of the invention, there is provided a sheet manufacturing apparatus, including: a supplying unit configured to supply a cut-form material including fibers; a detection unit configured to detect information related to a weight of the material which is processed to be supplied by the supplying unit; a defibrating unit configured to defibrate the material; and a forming unit configured to form a sheet by using at least a part of a defibrated material defibrated by the defibrating unit, in which a supply interval of at least one material among a plurality of materials to be supplied later changes in accordance with the weight of the material which is supplied at a unit time.

In the sheet manufacturing apparatus, by detecting the information related to the weight of the material which is processed to be supplied, and changing the supply interval of at least one material among the materials to be supplied later in accordance with the weight of the material which is supplied at a unit time, even when the supply amount temporarily changes, it is possible to reduce the change in the grammage of the formed sheet, and to improve the quality of the sheet.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, appropriate embodiments of the invention will be described in detail with reference to the drawings. In addition, the embodiments which will be described hereinafter do not inappropriately limit the content of the invention which is described within a range of aspects of the patent. In addition, all of configurations which will be described hereinafter are not necessarily essential configuration conditions of the invention.

1. Configuration

Figure 1:
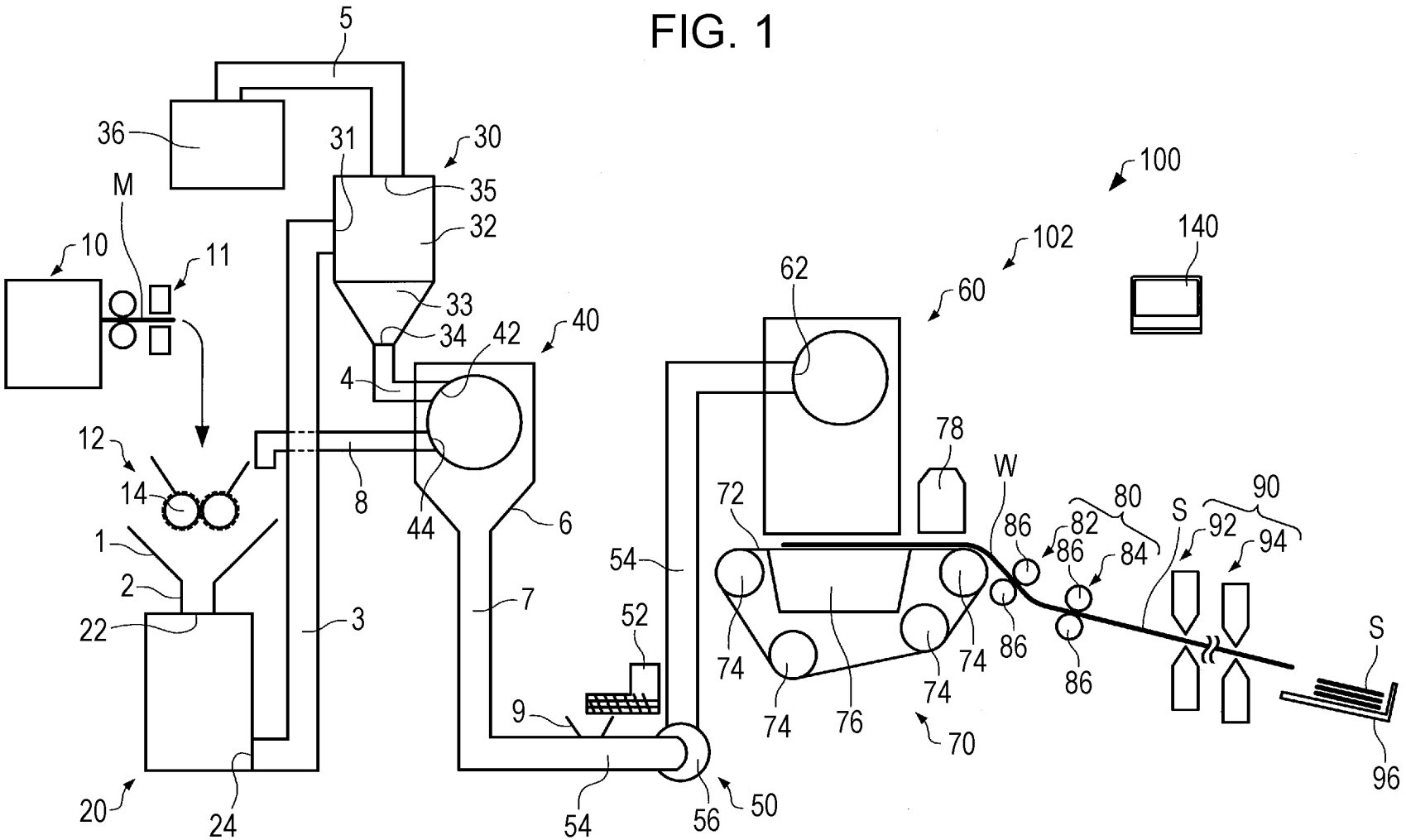
FIG. 1 is a schematic view illustrating a sheet manufacturing apparatus according to an embodiment.

First, a sheet manufacturing apparatus according to an embodiment will be described with reference to the drawings. FIG. 1 is a schematic view illustrating a sheet manufacturing apparatus 100 according to the embodiment.

As illustrated in FIG. 1, the sheet manufacturing apparatus 100 includes a supplying unit 10, a detection unit 11, a manufacturing unit 102, and a control unit 140. The manufacturing unit 102 manufactures a sheet. The manufacturing unit 102 includes a crushing unit 12, a defibrating unit 20, a classifying unit 30, a screening unit 40, a mixing unit 50, a deposition unit 60, a web forming unit 70, a sheet forming unit 80, and a cutting unit 90. In the specification, the mixing unit 50, the deposition unit 60, and the web forming unit 70 are collectively referred to as a forming unit.

The supplying unit 10 supplies a raw material M to the crushing unit 12. The supplying unit 10 is, for example, an automatic input unit for continuously inputting the raw material M to the crushing unit 12. The raw material M which is supplied by the supplying unit 10 is a cut-form material including fibers, and for example, a used paper sheet or a pulp sheet. The supplying unit 10 has a mechanism which accommodates a plurality of cut-form materials and feeds the accommodated material to the outside one by one.

The detection unit 11 detects information related to a weight of the raw material M (material) which is processed to be supplied by the supplying unit 10. The detection unit 11 detects, for example, at least one of information showing that the supplied materials are overlapped (overlapped sending of the materials), information showing that the material is not supplied (unloaded sending of the material), information showing the weight of the material, information showing a grammage of the material, and information showing a thickness of the material, as the information (weight information) related to the weight of the material which is processed to be supplied. Examples of the detection unit 11 includes a contact type or a non-contact type optical thickness sensor, displacement sensor, weight sensor (grammage sensor), or overlapped sending sensor.

The crushing unit 12 cuts and makes the raw material M which is supplied by the supplying unit 10 into small pieces in the air. The shape and the size of the small pieces are several cm square, for example. In the example illustrated in the drawing, the crushing unit 12 includes a crushing blade 14, and it is possible to cut the input raw material M by the crushing blade 14. As the crushing unit 12, it is possible to use a shredder, for example. The raw material which is cut by the crushing unit 12 is carried (transported) to the defibrating unit 20 via a pipe 2 after being received by a hopper 1.

The defibrating unit 20 defibrates the raw material which is cut by the crushing unit 12. Here, "defibrate" means untangling the fibers in the raw material (defibration object) which is made by bonding together a plurality of fibers one by one. The defibrating unit 20 also has a function of separating materials, such as resin grains, ink, toner, or a blur-preventing agent, which are attached to the raw material from the fibers.

The material which passes through the defibrating unit 20 is called a "defibrated material". There is also a case where examples of the "defibrated material" include resin (resin for bonding together a plurality of fibers to each other) grains which are separated from the fibers when untangling the fibers, a coloring material, such as ink and toner, or an additive, such as a blur-preventing agent and a paper strengthening agent, in addition to the untangled defibrated fibers. The shape of the untangled defibrated material is a string shape or a ribbon shape. The untangled defibrated material may exist in a state of not being intertwined with other untangled fibers (a state of being independent), or may exist in a state of being intertwined with other untangled defibrated materials in a shape of a mass (a state where so-called "lumps" are formed).

The defibrating unit 20 performs defibration by a dry method in the atmosphere (in the air). Specifically, as the defibrating unit 20, for example, an impeller mill is used. The defibrating unit 20 has a function of generating an airflow to suck the raw material and discharge the defibrated material. Accordingly, the defibrating unit 20 can suck the raw material together with the airflow from an introduction port 22, perform defibration processing, and transport the raw material to a discharge port 24, by the airflow which is generated from the defibrating unit 20 itself. The defibrated material which passes through the defibrating unit 20 is transported to the classifying unit 30 via a pipe 3.

The classifying unit 30 classifies the defibrated material which passes through the defibrating unit 20. Specifically, the classifying unit 30 separates and removes a defibrated material (resin grains, a coloring material, an additive, or the like) which has a relatively small size or a relatively low density among the defibrated materials. Accordingly, it is possible to increase a proportion of fibers which has a relatively large size or a relatively high density among the defibrated materials.

As the classifying unit 30, an airflow classifier is used. The airflow classifier generates a swirling airflow and performs separation in accordance with a difference between centrifugal forces received according to the size and the density of the classified materials. By adjusting the speed and the centrifugal force of the airflow, it is possible to adjust a classification point. Specifically, as the classifying unit 30, a cyclone, an elbow jet, or an Eddy classifier, is used. In particular, since the cyclone has a simple structure, it is possible to appropriately use the cyclone as the classifying unit 30.

The classifying unit 30 includes, for example, an introduction port 31, a cylinder unit 32 to which the introduction port 31 is connected, an inverse cone unit 33 which is positioned below the cylinder unit 32 and continues to the cylinder unit 32, a lower discharge port 34 which is provided in the center of a lower part of the inverse cone unit 33, and an upper discharge port 35 which is provided in the center of an upper part of the cylinder unit 32.

In the classifying unit 30, the airflow which has the defibrated material introduced from the introduction port 31 therein changes its directions of flow into a circumferential movement by the cylinder unit 32. Accordingly, the centrifugal force is applied to the introduced defibrated material, and the classifying unit 30 can separate the fibers (first classified material) having a larger size and a higher density than that of resin grains, a coloring material, or an additive in the defibrated material, or resin grains, a coloring material, or an additive (second classified material) which have a smaller size and a lower density than that of the fibers in the defibrated material. The first classified material is discharged from the lower discharge port 34 and introduced to the screening unit 40 via a pipe 4. Meanwhile, the second classified material is discharged to a receiving unit 36 via a pipe 5 from the upper discharge port 35.

The screening unit 40 introduces the first classified material which passes through the classifying unit 30 from an introduction port 42, and performs screening according to the length of the fibers. As the screening unit 40, for example, a sieve is used. The screening unit 40 includes a net (filter and screen), and can divide fibers or grains (first screened material which passes through the net) which are included in the first classified material and are smaller than an aperture of the net, and fibers, undefibrated pieces, or lumps (second screened material which does not pass through the net) which is greater than the aperture of the net. For example, the first screened material is carried to the mixing unit 50 via a pipe 7 after being received by a hopper 6. The second screened material returns to the defibrating unit 20 via a pipe 8 from a discharge port 44. Specifically, the screening unit 40 is a cylindrical sieve which can be rotated by a motor. The net of the screening unit 40 uses, for example, mesh, an expandable metal which is made by expanding a metal plate having a notch, and a punching metal which has holes formed by a press machine or the like on the metal plate.

The mixing unit 50 mixes the first screened material which passes through the screening unit 40, and an additive agent which includes a resin. The mixing unit 50 constitutes a part of the forming unit. The mixing unit 50 includes an additive agent supplying unit 52 which supplies the additive agent, a pipe 54 which transports the screened material and the additive material, and a blower 56. In the example illustrated in the drawing, the additive material is supplied to the pipe 54 via a hopper 9 from the additive agent supplying unit 52. The pipe 54 continues to the pipe 7.

In the mixing unit 50, it is possible to transport the first screened material and the additive material while generating an airflow by the blower 56 and mixing the first screened material and the additive material in the pipe 54. In addition, a mechanism which mixes the first screened material and the additive material is not particularly limited, may be a mechanism which performs stirring by an impeller blade which rotates, and may be a mechanism which uses the rotation of a container, such as a V-type mixer. In addition, the mixing unit 50 may include a plurality of rotary units having rotating blades, and may make the first screened material (fibers) and the additive (resin) pass through the related rotary unit and mix the materials.

As the additive agent supplying unit 52, a screw feeder illustrated in FIG. 1 or a disk feeder which is not illustrated is used. The additive material which is supplied from the additive agent supplying unit 52 includes a resin for bonding a plurality of fibers to each other. At the time when the resin is supplied, the plurality of fibers are not bonded to each other. The resin is melted when passing through the sheet forming unit 80, and bonds the plurality of fibers to each other.

In addition, in the additive material which is supplied from the additive agent supplying unit 52, in addition to the resin which bonds the fibers to each other, in accordance with a type of the sheet to be manufactured, a colorant for coloring the fibers, a coagulation inhibitor for inhibiting coagulation of the fibers, or a flame retardant for making the fibers difficult to ignite, may be included. A mixed material (mixed material of the first screened material and the additive material) which passes through the mixing unit 50 is carried to the deposition unit 60 via the pipe 54.

The deposition unit 60 introduces the mixed material which passes through the mixing unit 50 from an introduction port 62, untangles the intertwined defibrated material (fibers), and makes the defibrated material fall downwards while being dispersed in the air. The deposition unit 60 constitutes a part of the forming unit. In addition, the deposition unit 60 can be called an ejecting unit which ejects the mixed material and makes the mixed material fall downwards to the web forming unit 70. Furthermore, when the resin of the additive material which is supplied from the additive agent supplying unit 52 is in a shape of a fiber, the deposition unit 60 untangles the intertwined resin. Accordingly, the deposition unit 60 can deposit the mixed material with high uniformity onto the web forming unit 70.

As the deposition unit 60, a cylindrical sieve which rotates is used. The deposition unit 60 includes a net, and makes the fibers or the grains (materials which pass through the net) which are included in the mixed material that passes through the mixing unit 50 and are smaller than an aperture of the net fall. A configuration of the deposition unit 60 is the same as the configuration of the screening unit 40, for example.

In addition, the "sieve" of the deposition unit 60 may not have a function of screening a specific target. In other words, the "sieve" which is used as the deposition unit 60 means a sieve which is provided with a net, and the deposition unit 60 may make all of the mixed materials which are introduced to the deposition unit 60 fall.

The web forming unit 70 deposits a passed material which passes through the deposition unit 60, and forms a web W. The web forming unit 70 constitutes a part of the forming unit, and forms the web W by an air-laid method. The web forming unit 70 includes, for example, a mesh belt 72, a stretching roller 74, and a suction mechanism 76.

The mesh belt 72 deposits the passed material which passes through an opening (opening of the net) of the deposition unit 60 while moving. The mesh belt 72 is configured to stretch by the stretching roller 74, makes the passed material difficult to pass, and allows the air to pass through. The mesh belt 72 is moved as the stretching roller 74 revolves. While the mesh belt 72 continuously moves, as the passed materials which pass through the deposition unit 60 continuously fall downwards and pile up, the web W is formed on the mesh belt 72. The mesh belt 72 is made of, for example, metal, resin, cloth, or a non-woven fabric. An airflow which includes the mixed materials that are dropped from the deposition unit 60 is received by the mesh belt 72 and air passes through the mesh belt 72 so that the mixed materials are captured in the mesh belt 72.

The suction mechanism 76 is provided below the mesh belt 72 (on a side opposite to the deposition unit 60 side). The suction mechanism 76 can generate an airflow (airflow which is oriented to the mesh belt 72 from the deposition unit 60) which flows downward. By the suction mechanism 76, it is possible to suck the mixed material which is ejected and dispersed in the air by the deposition unit 60 on the mesh belt 72. In other words, the suction mechanism 76 can be called a suction unit which sucks the mixed material ejected by the deposition unit 60 via the mesh belt 72. Accordingly, it is possible to increase a discharge speed from the deposition unit 60. Furthermore, by the suction mechanism 76, it is possible to form a downstream flow to a dropping route of the mixed material, and to prevent the defibrated material or the additive material from being intertwined while falling downward.

As described above, as passing by the deposition unit 60 and the web forming unit 70 (web forming), the web W which is in a state of having a large amount of air and being swollen and softened is formed. The web W which is deposited on the mesh belt 72 is transported to the sheet forming unit 80.

In addition, in the example illustrated in the drawing, a moisture-adjusting unit 78 which adjusts moisture of the web W is provided. The moisture-adjusting unit 78 can add water or vapor to the web W, and adjust a quantity ratio between the web W and the water.

The sheet forming unit 80 heat-pressurizes the web W which is deposited on the mesh belt 72, and forms a sheet S. The sheet forming unit 80 constitutes a part of the forming unit. In the sheet forming unit 80, by applying heat to the mixed material of the defibrated material and the additive material that are mixed in the web W, it is possible to bond the plurality of fibers in the mixed material to each other via the additive material (resin).

As the sheet forming unit 80, for example, a heating roller (heater roller), a heat press forming machine, a hot plate, a warm air blower, an infrared heater, or a flash fixing device, is used. In the example illustrated in the drawing, the sheet forming unit 80 is provided with a first bonding unit 82 and a second bonding unit 84, and the bonding units 82 and 84 are respectively provided with one pair of heating rollers 86. As the bonding units 82 and 84 are configured as the heating rollers 86, compared to a case where the bonding units 82 and 84 are configured as a press apparatus (flat plate press apparatus) in a shape of a plate, it is possible to form the sheet S while continuously transporting the web W. In addition, the number of the heating rollers 86 is not particularly limited.

The cutting unit 90 cuts the sheet S which is formed by the sheet forming unit 80. In the example illustrated in the drawing, the cutting unit 90 includes a first cutting unit 92 which cuts the sheet S in a direction which intersects with a transporting direction of the sheet S, and a second cutting unit 94 which cuts the sheet S in a direction which is parallel to the transporting direction. The second cutting unit 94 cuts, for example, the sheet S which passes through the first cutting unit 92.

As described above, a cut-form sheet S having a predetermined size is formed. The cut cut-form sheet S is discharged to a discharge unit 96.

Figure 2:
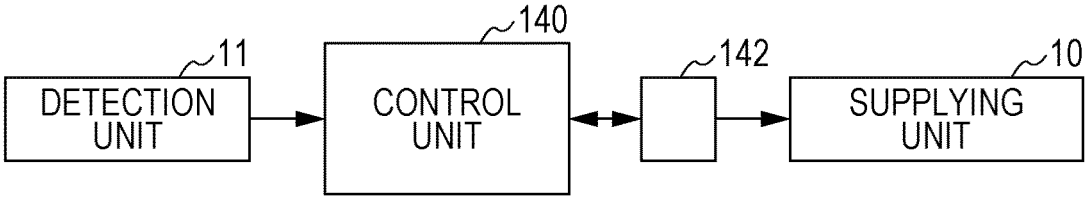
FIG. 2 is a functional block diagram of the sheet manufacturing apparatus according to the embodiment.

FIG. 2 is a functional block diagram of a sheet manufacturing apparatus 100. The sheet manufacturing apparatus 100 includes the control unit 140 that has a CPU and a storage unit (ROM, RAM). The control unit 140 outputs a control signal to a driver 142 (motor driver). The driver 142 controls the motor of the supplying unit 10 based on the control signal and drives the supplying unit 10. In addition, the weight information (information related to the weight of the material which is processed to be supplied by the supplying unit 10) which is detected by the detection unit 11 is output to the control unit 140.

Based on the weight information which is detected by the detection unit 11, the control unit 140 outputs the control signal to the driver 142, and controls the operation (operation for supplying the cut-form material) of the supplying unit 10. More specifically, the control unit 140 performs a change in a supply interval of the material (at least one material) to be supplied later in accordance with the weight of the material which is supplied at a unit time, the weight being grasped based on the weight information detected by the detection unit 11.

2. Technique of Embodiment

Next, a technique of a supply control in the sheet manufacturing apparatus 100 of the embodiment will be described.

Figure 3A:
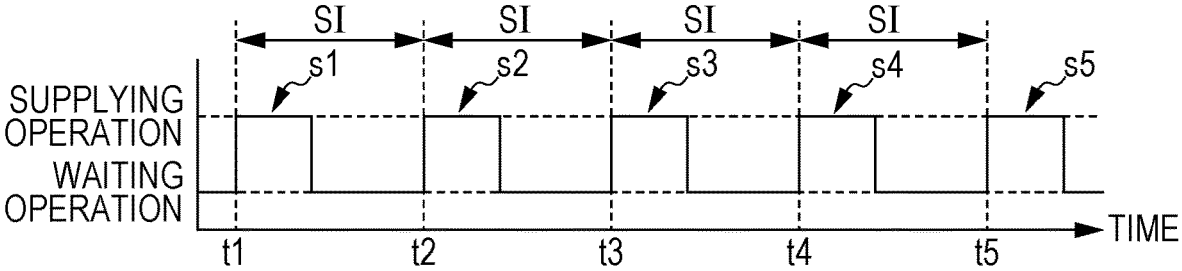
FIGS. 3A to 3C are views illustrating a supplying operation of a supplying unit.

FIG. 3A is a view illustrating an example of a supplying operation of the supplying unit 10. As illustrated in FIG. 3A, the supplying unit 10 supplies the cut-form material to the crushing unit 12 one by one, alternately repeating a supplying operation which supplies one material and a waiting operation which does not perform the supplying operation. In the example illustrated in FIG. 3A, the material is supplied at a constant supply interval SI. Here, the supply interval SI is called a time interval (for example, an interval from time t1 to t2) from initiating the supplying operation (for example, a supplying operation s1) until initiating the next supplying operation (for example, supplying operation s2). In addition, here, it is assumed that the weight (grammage, thickness) of the cut-form material is constant.

In the technique of the embodiment, the supply interval SI of the material to be supplied later is controlled to increase in a case where the weight of the material which is supplied at a unit time is heavy rather than in a case where the weight is light. For example, when it is detected that overlapped sending is generated (the supplied materials overlap with each other) when the supplying operation is performed, the supply interval of the material to be supplied next increases.

Figure 3B:
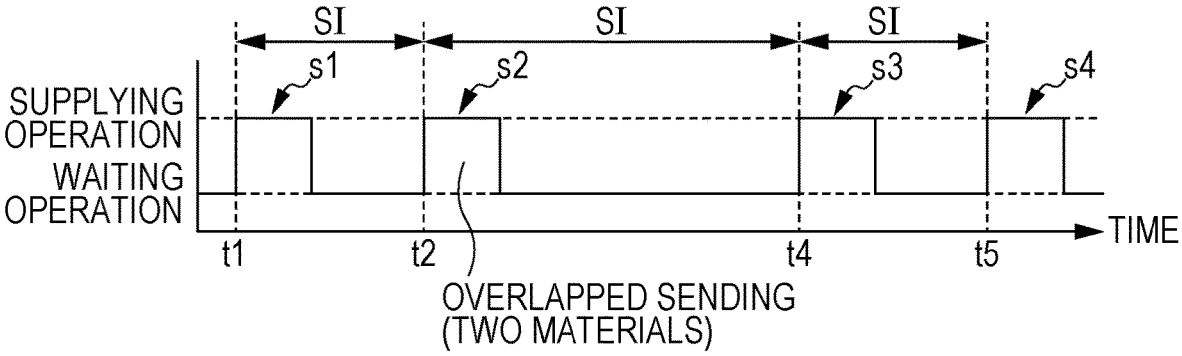

In the example illustrated in FIG. 3B, since the overlapped sending (the weight of the material which is supplied at a unit time is 2 times that at a normal time) of two materials is detected in the supplying operation s2, the supply interval SI (supply interval SI of the supplying operation s2) until the next supplying operation s3 is initiated changes to be 2 times that at a normal time. In this case, in a total of three materials are supplied from the time t1 to t4, and the supply amount during the period from the time t1 to t4 becomes equivalent to that at a normal time as illustrated in FIG. 3A. Therefore, even when the supply amount temporarily increases due to the overlapped sending of the materials, by reducing the following supply amount, it is possible to reduce the change in the grammage of the formed sheet, and to improve a quality of the sheet. In addition, by increasing the supply interval of the material to be supplied following the supplying operation in which the overlapped sending is detected, it is possible not to prolong the influence of the temporary increase in the supply amount. In addition, when the overlapped sending of N materials is detected, the supply interval SI for supplying the next material changes to be N times that at a normal time.

Figure 3C:
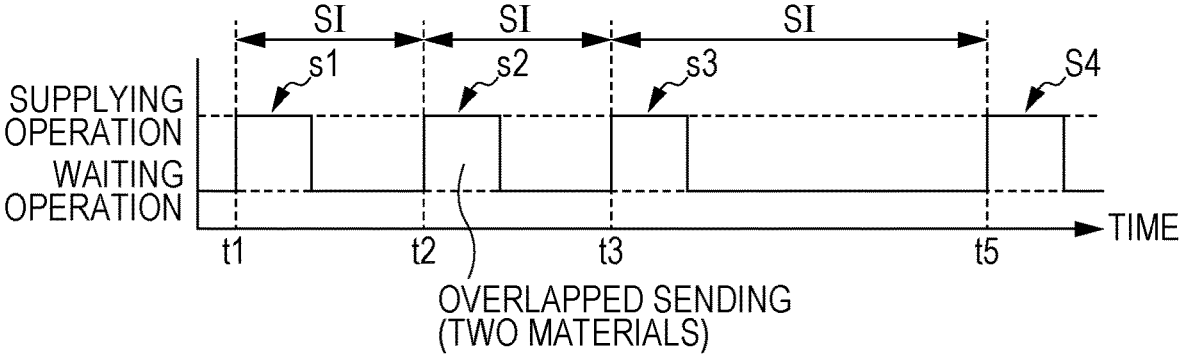

Here, when the overlapped sending is detected, in a case where the next supplying operation is already initiated, the supply interval of the material to be supplied next increases. In the example illustrated in FIG. 3C, when the overlapped sending of two materials is detected in the supplying operation s2, since the next supplying operation s3 is already initiated, the supply interval SI (supply interval SI of the supplying operation s3) until the next supplying operation s4 is initiated changes to be 2 times that at a normal time. Even in this case, in a total of four materials are supplied from the time t1 to t5, and the supply amount during the period from the time t1 to t5 becomes equivalent to that at a normal time as illustrated in FIG. 3A.

In addition, in the technique of the embodiment, the supply interval SI of the material to be supplied later is controlled to decrease in a case where the weight of the material which is supplied at a unit time is light rather than in a case where the weight is heavy. For example, when it is detected that the unloaded sending is generated (the material is not supplied) when the supplying operation is performed, the supplying interval of the material to be supplied next decreases.

Figure 4A:
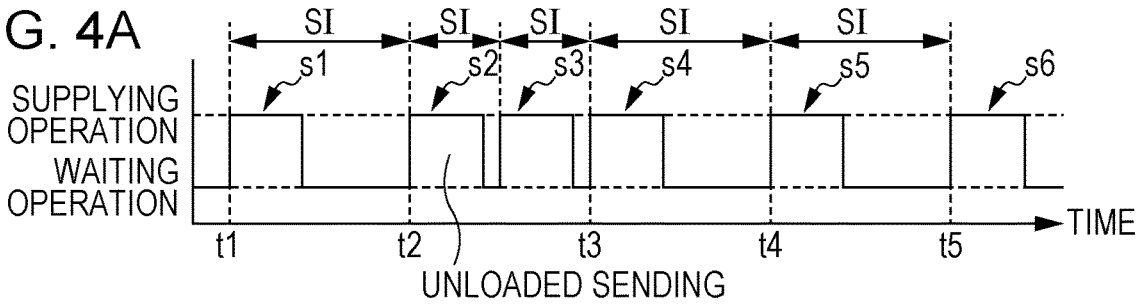
FIGS. 4A to 4C are views illustrating a supplying operation of the supplying unit.

In the example illustrated in FIG. 4A, since the unloaded sending (the weight of the material which is supplied at a unit time is 0) is detected in the supplying operation s2, the supply interval SI between the supply interval SI (supply interval SI of the supplying operation s2) until the next supplying operation s3 is initiated and the supply interval SI of the supplying operation s3 changes to be 0.5 times that at a normal time. In this case, in a total of two (in a total of one material between the time t2 to t3) materials are supplied from the time t1 to t3, and the supply amount from the time t1 to t3 (time t2 to t3) becomes equivalent to that at a normal time as illustrated in FIG. 3A. Therefore, by increasing the following supply amount even when the supply amount is temporarily reduced due to the unloaded sending of the material, it is possible to reduce the change in the grammage of the formed sheet, and to improve the quality of the sheet. In addition, by decreasing the supply interval of the material to be supplied after the supplying operation in which the unloaded sending is detected, it is possible not to prolong the influence of the temporary decrease in the supply amount.

Here, when the unloaded sending is detected, in a case where the next supplying operation is already initiated, the supply interval of the material to be supplied next decreases. In the example illustrated in FIG. 4B, since the next supplying operation s3 is already initiated when the unloaded sending is detected in the supplying operation s2, the supply interval SI of the supplying operation s3 and the supply interval SI of the following supplying operation s4 change to be 0.5 times that at a normal time. Even in this case, by supplying in a total of three materials from the time t1 to t4, the supply amount from the time t1 to t4 becomes equivalent to that at the normal time illustrated in FIG. 3A.

Figure 4B:
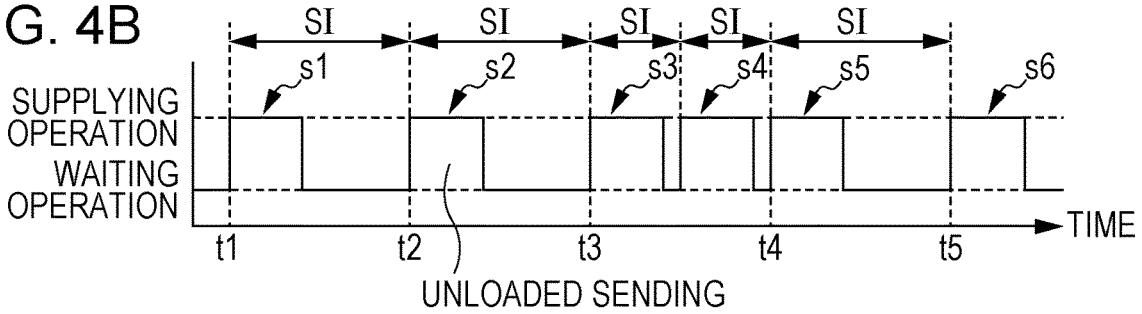

In addition, in the example illustrated in FIGS. 4A and 4B, when the unloaded sending is detected, the supply interval SI decreases so that the supplying operation is performed two times at the time interval which corresponds to the supply interval (for example, the supply interval SI of the supplying operation s1) at a normal time. However, the supply interval may decrease so that the supplying operation is performed (N+1) times at the time interval which is N times the supply interval at a normal time. In the example illustrated in FIG. 4C, the supply interval decreases so that the supplying operations s3 to s5 are performed three times at the time interval (time t3 to t5) which is 2 times the supply interval at a normal time. Even in this case, in a total of four materials are supplied from the time t1 to t5, and the supply amount during the period from the time t1 to t5 becomes equivalent to that at a normal time as illustrated in FIG. 3A.

Figure 4C:
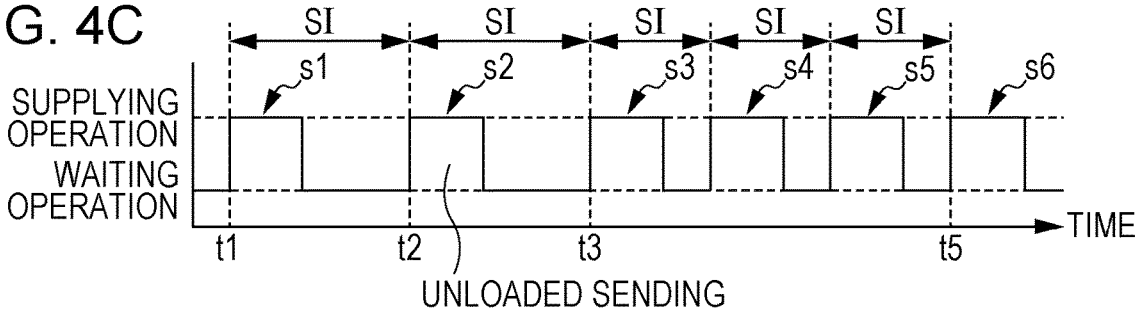

Here, it is desirable that a duty ratio (ratio of time for performing the supplying operation that accounts for the supply interval) of the supplying operation is less than 50%. When the duty ratio of the supply interval is less than 50%, as illustrated in FIGS. 4A and 4B, it is possible to perform the supplying operation two times during the time interval which corresponds to the supply interval at a normal time, and to immediately eliminate the influence of the temporary decrease in the supply amount due to the unloaded sending. In addition, when the duty ratio of the supply interval is equal to or greater than 50%, as illustrated in FIG. 4C, the supply interval may decrease so that the supplying operation is performed (N+1) times during the time interval which is N times the supply interval at a normal time.

In addition, in the technique of the embodiment, in addition to (or instead of) judging whether or not the overlapped sending or the unloaded sending is generated when the supplying operation is performed, it is judged whether or not the weight or the like (any of weight, grammage, and thickness) of the material which is supplied at a unit time exceeds a predetermined reference range, and the supply interval may change based on the judgement result. In this case, when the weight or the like (a value based on the detected weight information) of the supplied material is above (for example, equal to or greater than 1.4 times, and less than 2 times a standard value) the reference range, the supply interval increases within the range which is less than 2 times that at a normal time, and when the weight or the like of the supplied material is below (for example, greater than 0 times, and equal to or less than 0.8 times the standard value) the reference range, the supply interval decreases within the range which is equal to or greater than 0.5 times that at a normal time. In addition, when the weight or the like of the supplied material is equal to or greater than 2 times the standard value, it is judged that the overlapped sending is generated and the supply interval is set to be equal to or greater than 2 times that at a normal time, and when the weight or the like of the supplied material is 0 times the standard value (in other words, the weight or the like is 0), it is judged that the unloaded sending is generated and the supply interval is set to be, for example, 0.5 times that at a normal time. In addition, when the weight or the like of the supplied material is within the reference range (for example, greater than 0.8 times, and less than 1.4 times the standard value), the supply interval remains as it is at a normal time.

Figure 5A:
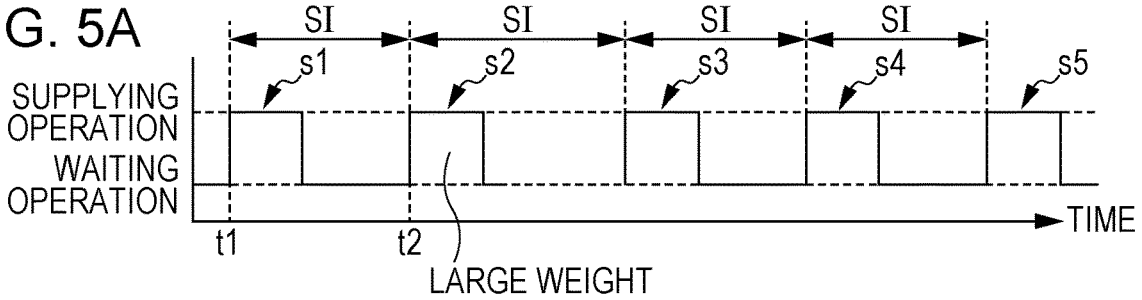
FIGS. 5A and 5B are views illustrating a supplying operation of the supplying unit.

In the example illustrated in FIG. 5A, since it is judged that the weight or the like of the material supplied by the supplying operation s2 is above the reference range, the supply interval SI (supply interval SI of the supplying operation s2) until the following supplying operation s3 is initiated changes to increase to be greater than that at a normal time. In this case, instead of the supply interval SI of the supplying operation s2, the supply interval SI of the supplying operation s3 may increase.

Figure 5B:
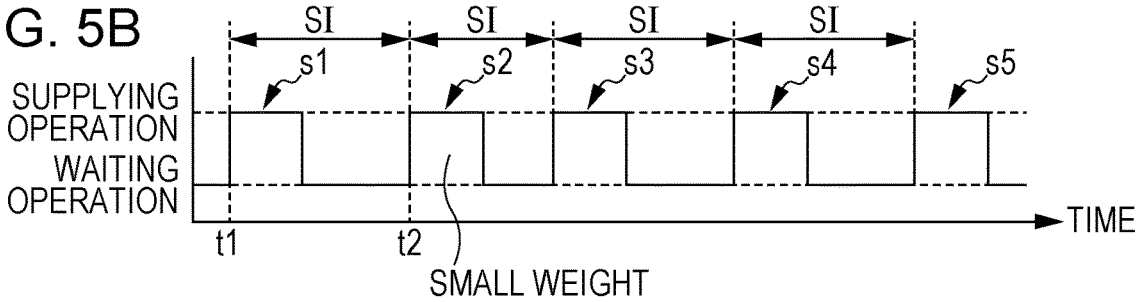

In addition, in the example illustrated in FIG. 5B, since it is judged that the weight or the like of the material supplied by the supplying operation s2 is below the reference range, the supply interval SI (supply interval SI of the supplying operation s2) until the following supplying operation s3 is initiated changes to decrease less than that at a normal time. In this case, instead of the supply interval SI of the supplying operation s2, the supply interval SI of the supplying operation s3 may decrease.

In this manner, by judging whether the weight or the like of the material supplied at a unit time is above or below the predetermined reference range, and changing the supply interval based on the judgement result, even when the supply amount temporarily changes as the materials having different weights or the like are supplied, it is possible to reduce the change in the grammage of the formed sheet, and to improve the quality of the sheet. In addition, based on the weight or the like (detected weight information) of the material supplied at a unit time, the supply interval of the material to be supplied later may be directly calculated.

3. Processing

Figure 6:
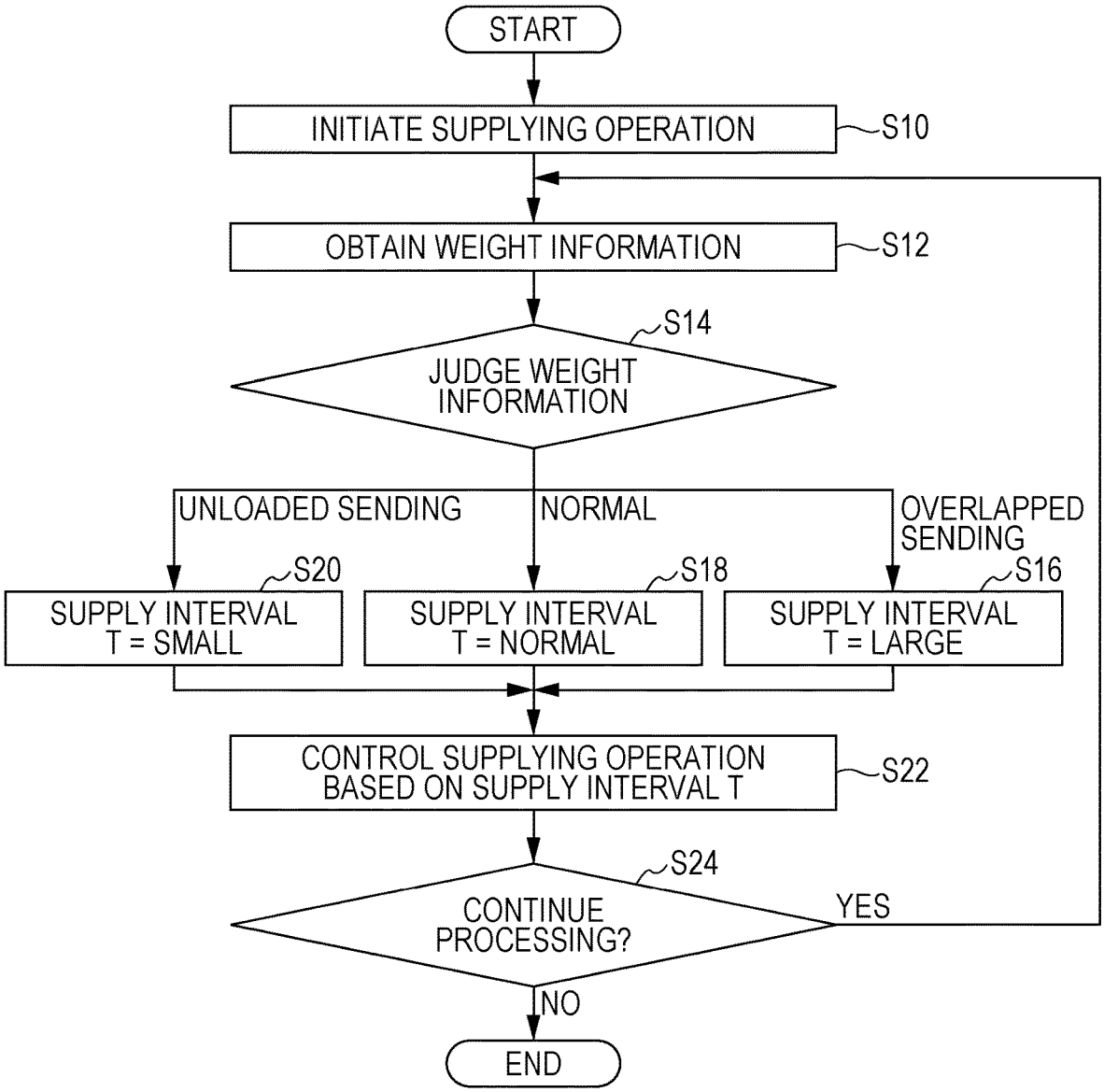
FIG. 6 is a flow chart illustrating a flow of a supply control according to the embodiment.

Next, the supply control in the sheet manufacturing apparatus 100 of the embodiment will be described with reference to flow charts in FIGS. 6 to 8. FIG. 6 is a flow chart illustrating a flow of the supply control when only the overlapped sending and the unloaded sending of the material are detected.

First, the control unit 140 outputs the control signal to the driver 142, and initiates the operation (supply operation) of the supplying unit 10 (step S10). Next, the control unit 140 obtains the weight information detected by the detection unit 11 (step S12). Next, based on the obtained weight information, the control unit 140 judges whether the overlapped sending is generated, the unloaded sending is generated, or any of the overlapped sending and the unloaded sending is not generated (step S14).

When it is judged that the overlapped sending is generated, the control unit 140 sets a supply interval T to be a value (for example, a value 2 times that at a normal time in a case of the overlapped sending of two materials) which is greater than that at a normal time (step S16). In addition, when it is judged that both the overlapped sending and the unloaded sending are not generated, the control unit 140 sets the supply interval T to be a value at a normal time (step S18). In addition, when it is judged that the unloaded sending is generated, the control unit 140 is set to be a value which is less than that at a normal time (step S20).

Next, based on the supply interval T set in any of steps S16 to S20, the control unit 140 outputs the control signal to the driver 142, and controls the operation of the supplying unit 10 (step S22). For example, when it is judged that the overlapped sending is generated, the operation of the supplying unit 10 is controlled so that the supply interval of the material to be supplied next (or later) increases to be greater than that at a normal time, and when it is judged that the unloaded sending is generated, the operation of the supplying unit 10 is controlled so that the supply interval of the material to be supplied next (or later) decreases to be less than that at a normal time. Next, when the control unit 140 determines whether or not to continue the processing (step S24), and when the processing continues (Y in step S24), the process moves to the step S12. For example, in a case where the number of supplied materials reaches a predetermined number, or in a case where a remaining amount of the material accommodated in the supplying unit 10 becomes 0, the control unit 140 ends the processing, and in other cases, the processing continues.

Figure 7:
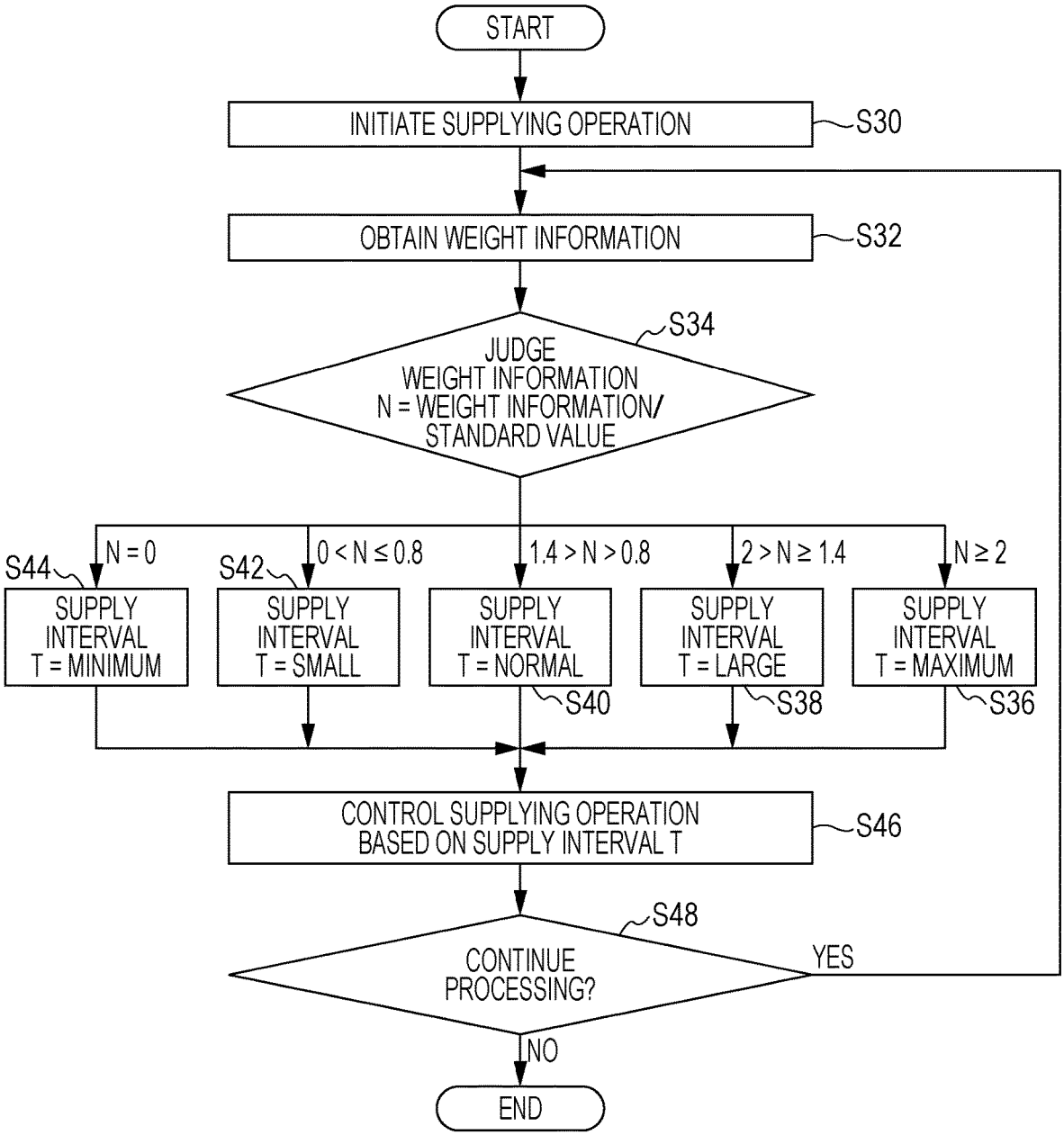
FIG. 7 is a flow chart illustrating a flow of the supply control according to the embodiment.

FIG. 7 is a flow chart illustrating a flow of the supply control when it is detected whether the weight or the like of the material is above or below the reference range in addition to the overlapped sending and the unloaded sending of the material.

First, the control unit 140 outputs the control signal to the driver 142, and initiates the operation of the supplying unit 10 (step S30). Next, the control unit 140 obtains the weight information detected by the detection unit 11 (step S32). Next, based on the obtained weight information, the control unit 140 judges whether the overlapped sending is generated, the unloaded sending is generated, the weight or the like of the material is above or below the reference range, or the weight or the like of the material is within the reference range (step S34). Here, based on the obtained weight information, N (N=weight information/standard value) is calculated, and the judgement is performed based on the value of the calculated N.

When the value of the calculated N is equal to or greater than 2 (that is, the weight or the like of the detected material is equal to or greater than 2 times the standard value), the control unit 140 judges that the overlapped sending is generated, and sets the supply interval T to be the maximum value (for example, in a case of the overlapped sending of two materials, a value which is 2 times that at a normal time) (step S36). In addition, when the value of the calculated N is equal to or greater than 1.4 and less than 2, the control unit 140 judges that the weight or the like of the material is above the reference range, and sets the supply interval T to be a value which is greater than the value at a normal time and less than the maximum value (step S38). In addition, when the value of the calculated N is greater than 0.8 and less than 1.4, the control unit 140 judges that the weight or the like of the material is within the reference range, and sets the supply interval T to be the value at a normal time (step S40). In addition, when the value of the calculated N is greater than 0 and equal to or less than 0.8, the control unit 140 judges that the weight or the like of the material is below the reference range, and sets the supply interval T to be a value which is less than the value at a normal time and greater than a minimum value (step S42). In addition, when the value of the calculated N is 0, the control unit 140 determines that the unloaded sending is generated, and sets the supply interval T to be the minimum value (step S44).

Next, based on the supply interval T set in any of steps S36 to S44, the control unit 140 outputs the control signal to the driver 142, and controls the operation of the supplying unit 10 (step S46). Next, the control unit 140 determines whether or not to continue the processing (step S48), and when the processing continues (Y in step S48), the process moves to the step S32.

Figure 8:
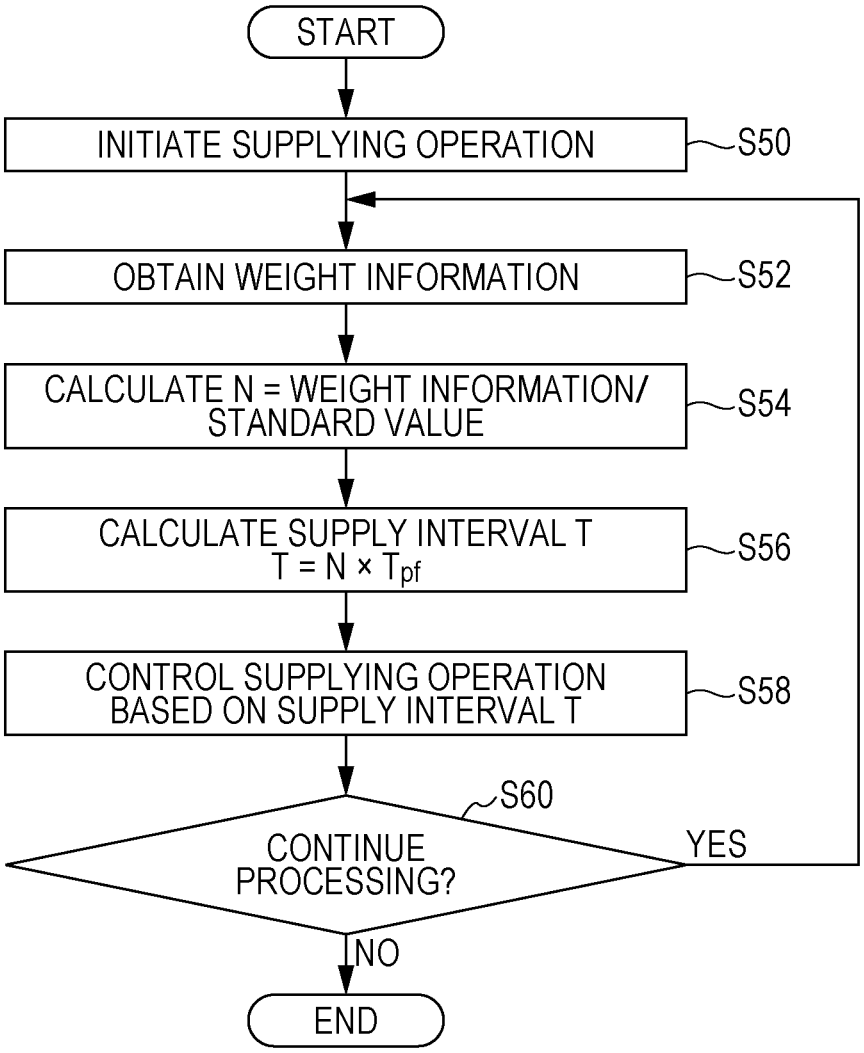
FIG. 8 is a flow chart illustrating a flow of the supply control according to the embodiment.

FIG. 8 is a flow chart illustrating a flow of the supply control when the supply interval is directly required from the detected weight information.

First, the control unit 140 outputs the control signal to the driver 142, and initiates the operation of the supplying unit 10 (step S50). Next, the control unit 140 obtains the weight information detected by the detection unit 11 (step S52). Next, based on the obtained weight information, N (N=weight information/standard value) is calculated (step S54). Next, based on the value of calculated N and a supply interval $T_{Pf}$ at a normal time, the control unit 140 calculates the supply interval T ($T=N\times T_{Pf}$) (step S56).

Next, based on the calculated supply interval T, the control unit 140 outputs the control signal to the driver 142, and controls the operation of the supplying unit 10 (step S58). Next, the control unit 140 determines whether or not to continue the processing (step S60), and when the processing continues (Y in step S60), the process moves to the step S52.

4. Modification Example

The invention is not limited to the above-described embodiment, and further various modifications are possible. For example, the invention includes a configuration (a configuration in which functions, methods, and results are the same, or a configuration in which a purpose and effects are the same) which is substantially the same as a configuration illustrated in the embodiment. In addition, the invention includes a configuration in which parts which are not essential in the configuration described in the embodiment are replaced. In addition, the invention includes a configuration which can achieve the same operation effects, or a configuration which can achieve the same purpose as those in the configuration described above. In addition, the invention includes a configuration in which a known technology is added to the configuration described in the embodiment.

In addition, the sheet S which is manufactured by the sheet manufacturing apparatus 100 and the sheet manufacturing method according to the invention mainly indicates a manufactured product which has a shape of a sheet by using at least the above-described fibers as a raw material. However, the shape thereof is not limited to the shape of a sheet, and may have a shape of a board, a web, or a concave and convex shape. The sheet of the specification can be divided into a paper sheet and non-woven fabric. The paper sheet includes a paper sheet which is formed in a shape of a sheet by using pulp or used paper sheet as a raw material, and includes recording paper for writing or printing, wall paper, wrapping paper, colored paper, drawing paper, or Kent paper. The non-woven fabric is thicker than the paper sheet, has a lower strength than that of the paper sheet, and includes general non-woven fabric, a fabric board, tissue paper, paper towel, a cleaner, a filter, a liquid absorbent, a sound absorbing material, a cushioning material, or a matting material.

In the above-described embodiment, as a detection unit, a case where a sensor which detects the weight or the like of the material to be processed to be supplied by the supplying unit 10 is independently provided is described, but the invention is not limited thereto. For example, by detecting a torque of the motor of the crushing unit 12 or the defibrating unit 20, and based on the detected torque, the weight or the like of the material to be processed to be supplied by the supplying unit 10 may be detected. In this case, for example, when the detected torque increases (doubles), it may be judged that the overlapped sending of the materials is generated.

The entire disclosure of Japanese Patent Application No. 2014-221576 filed Oct. 30, 2014 is expressly incorporated by reference herein.

What is claimed is:

1. A sheet manufacturing apparatus, comprising:

a supplying unit configured to supply a cut-form material including fibers;

a detection unit configured to detect information related to a weight of the material which is supplied by the supplying unit as part of a supplying operation;

a defibrating unit configured to defibrate the material, wherein the detection unit is configured to detect the information related to the weight of the material before the material is delivered to the defibrating unit; and a forming unit configured to form a sheet by using at least a part of a defibrated material defibrated by the defibrating unit, wherein a supply interval of at least one material among a plurality of materials to be supplied later changes in accordance with the weight of the material which is supplied by the supplying unit at a unit time compared with the weight of the material which is to be supplied by the supplying unit.

2. The sheet manufacturing apparatus according to claim 1, comprising:

wherein a supply interval of at least one material among a plurality of materials to be supplied later increases in a case where the weight of the material which is supplied at a unit time is heavy rather than in a case where the weight is light.

3. The sheet manufacturing apparatus according to claim 2, wherein the supply interval of the material to be supplied next increases in a case where the weight of the material which is supplied at a unit time is heavy rather than in a case where the weight is light.

4. The sheet manufacturing apparatus according to claim 2, wherein the information related to the weight of the material is information showing that the supplied materials overlap with each other.

5. The sheet manufacturing apparatus according to claim 2, wherein the supply interval of the plurality of materials to be supplied later decreases in a case where the weight of the material which is supplied at a unit time is light rather than in a case where the weight is heavy.

6. The sheet manufacturing apparatus according to claim 5, wherein the information related to the weight of the material is information showing that the material is not supplied.

7. The sheet manufacturing apparatus according to claim 1, wherein the information related to the weight of the material is information showing the weight of the material.

8. The sheet manufacturing apparatus according to claim 1, wherein the information related to the weight of the material is information showing a grammage of the material.

9. The sheet manufacturing apparatus according to claim 1, wherein the information related to the weight of the material is information showing the thickness of the material.

10. The sheet manufacturing apparatus according to claim 1, comprising:

wherein a supply interval of at least one material among a plurality of materials to be supplied later decreases in a case where the weight of the material which is supplied at a unit time is light rather than in a case where the weight is heavy.

11. The sheet manufacturing apparatus of claim 1, wherein each supply interval includes the supplying operation and a waiting operation.

12. The sheet manufacturing apparatus of claim 1, wherein the detection unit is positioned between the supplying unit and the defibrating unit.

* * * * *